US007070403B2

(12) United States Patent
Dzialas et al.

(10) Patent No.: US 7,070,403 B2
(45) Date of Patent: Jul. 4, 2006

(54) DEVICE FOR PRODUCING FIBERS FROM A THERMOPLASTIC SYNTHETIC RESIN

(75) Inventors: Ulrich Dzialas, Troisdorf (DE); Detlef Frey, Niederkassel (DE); Hans-Georg Geus, Niederkassel (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 5 days.

(21) Appl. No.: 10/712,796

(22) Filed: Nov. 13, 2003

(65) Prior Publication Data

US 2004/0131713 A1 Jul. 8, 2004

(30) Foreign Application Priority Data

Nov. 16, 2002 (EP) ..... 02025772

(51) Int. Cl.
*B28B 5/00* (2006.01)

(52) U.S. Cl. ..... 425/72.2; 425/7; 425/97; 425/186; 425/192 R; 425/192 S; 425/190; 425/464; 264/5; 264/12; 264/39

(58) Field of Classification Search ..... 425/7, 425/97, 72.2, 186, 192 R, 464, 190, 192 S; 264/5, 12, 39
See application file for complete search history.

(56) References Cited

U.S. PATENT DOCUMENTS

| | | | | |
|---|---|---|---|---|
| 3,718,166 | A * | 2/1973 | Gordon | 141/236 |
| 4,295,809 | A * | 10/1981 | Mikami et al. | 425/72.2 |
| 5,017,112 | A * | 5/1991 | Mende et al. | 425/72.2 |
| 5,352,109 | A * | 10/1994 | Benenati | 425/192 R |
| 5,632,938 | A * | 5/1997 | Buehning, Sr. | 264/39 |
| 6,099,282 | A * | 8/2000 | Milligan | 425/7 |
| 6,244,845 | B1 * | 6/2001 | Milligan et al. | 425/7 |
| 2002/0034909 | A1 * | 3/2002 | Bansal et al. | 442/361 |
| 2003/0209825 | A1 * | 11/2003 | Timmons et al. | 264/40.7 |

FOREIGN PATENT DOCUMENTS

EP 474423 A * 3/1992

* cited by examiner

*Primary Examiner*—Robert Davis
*Assistant Examiner*—G. Nagesh Rao
(74) *Attorney, Agent, or Firm*—Andrew Wilford

(57) ABSTRACT

A nozzle for producing filaments or fibers of thermoplastic synthetic resin has at the nozzle end one or more bores, preferably opening at a flat surface and receiving respective inserts or shaped bodies which are formfitting in the bores and have along their peripheries respective nozzle channels opening at orifices through which the synthetic resin is discharged. Air streams may be directed at the strand at an acute angle when fibers are to be produced.

12 Claims, 4 Drawing Sheets

DEVICE FOR PRODUCING FIBERS FROM A THERMOPLASTIC SYNTHETIC RESIN

FIELD OF THE INVENTION

Our present invention relates to a device for producing fibers from a thermoplastic synthetic resin and, more particularly, to a device which can be used in a melt-blowing fiber-producing head and wherein molten synthetic resin emerging from a nozzle orifice encounters an airstream which subdivides emerging strands into such fibers.

BACKGROUND OF THE INVENTION

The production of fibers from thermoplastic synthetic resin is useful to produce mats or webs of such fibers with a high fluid permeability and capacity for use wherever nonwoven fabrics or fiber mats or fleeces are desirable.

In general an apparatus for producing such webs, e.g. by a melt-blowing process, may have a fiber-producing head with orifices from which the molten synthetic resin emerges.

Fiber-generating heads may also be used for other purposes. In general a device for the production of fiber or thermoplastic synthetic resins of the type with which the invention is concerned, can comprise at least one melt passage through which a molten synthetic resin is fed and at least one nozzle having an outlet end provided with a nozzle orifice from which the molten synthetic resin emerges.

The nozzle orifices may be bores which are formed directly at the tip of the nozzle or at least at a discharge side thereof. In the past, it has been customary to provide a single row of such nozzle bores or orifices at the nozzle tip. This greatly limits the density of the nozzle bores or orifices, i.e. the number of such bores or orifices per unit length or area. In many cases the density of the nozzle passages or the orifice density was smaller than 35 orifices per cm. As a general matter, moreover, the drilling of the nozzle is a very expensive procedure as is the preparation of a multiplicity of nozzles with different orifice densities and their substitution in a fiber-blowing head. As a result, such devices and fiber-blowing heads have not been fully satisfactory in the past.

OBJECTS OF THE INVENTION

It is, therefore, the principal object of the present invention to provide an improved fiber-blowing head or nozzle assembly which avoids the drawbacks of prior art devices and can be easily modified to change the number of orifices or to have a greater number of orifices per unit length or area than has hitherto been the case.

Another object of the invention is to provide an improved device for producing fibers of a thermoplastic synthetic resin in which a greater number of orifices can be accommodated per unit length while maintaining the cost for drilling the nozzle comparatively low.

Still another object of this invention is to provide a device for producing fibers from thermoplastic synthetic resins with a high orifice density or high density of nozzle passages.

It is an additional object of the invention to provide a nozzle which allows for variations of the size, number of arrangements of nozzle passages and/or orifices in a simple and flexible manner.

SUMMARY OF THE INVENTION

These objects and others which will become apparent hereinafter are attained, in accordance with the invention utilizing a device for producing fibers from thermoplastic synthetic resin which has at least one melt passage for the supply of molten synthetic resin. A nozzle is provided which at its outlet end has at least one row of nozzle passages with nozzle openings for the discharge of molten synthetic resin. In this outlet end of the nozzle, bores are provided, and in each bore a shaped body is formed-fittingly received. At least one nozzle passage is provided in a contact region between the shaped body and the bore. The invention includes, therefore, a system for which a nozzle may have only a single bore, a single body within that bore and a single nozzle passage formed between the shaped body and the wall of the bore as well as nozzles having a plurality of such bores each with a shaped body having a single nozzle passage, and embodiments in which the nozzle has a multiplicity of bores, each bore has a single shaped body form-fittingly received therein and each shaped body has a multiplicity of nozzle passages formed between its outer periphery and the wall of the respective bore.

The device for producing fibers of a thermoplastic synthetic resin can thus comprise:

a nozzle body formed with at least one melt passage for a molten thermoplastic synthetic resin and, at an outlet side of the nozzle body with a multiplicity of bores communicating with the passage; and respective members shaped to fit into the bores and received therein, each of the members defining at a periphery thereof, in a region of contact with a wall of the respective bore, at least one channel for the melt opening at a discharge orifice.

Within the framework of the invention, are devices which form part of a blowing head which comprises the melt passages and the nozzle and which also is capable of bringing about the interaction between the strands of thermoplastic synthetic resin which emerge from the orifices and a stream of air and which subdivide the strand into the filaments.

Thus the device in the principle of the present invention can theoretically generate continuous filaments, i.e. strands which are not subdivided as well as fibers which result from the subdivision of the strand. Both continuous filaments and the respective fibers can be collected into mats, fleeces and other nonwoven webs.

According to a preferred feature of the invention, the device for producing the fibers is part of a melt-blowing head and comprises feeds for the blowing half which is directed against the synthetic resin strands which emerge from the nozzle orifices at an acute angle thereto.

Preferably the air passages are provided on opposite sides of the nozzle or nozzle tip for directing the compressed air against the strands. These air passages can extend the full width of the device or nozzle. Preferably, in addition, the streams blown against this strand are flat jets which are continuous across the entire width of the apparatus. This width can, of course, correspond to the web width when the fiber-producing device is part of an apparatus for producing nonwoven webs. The air streams can, of course, also be directed against the strands from closely adjoining nozzle orifices or bores as individual jets which are trained upon the curtain of synthetic resin strands at an acute angle thereto. The streams from opposite sides of the strands can include an acute angle with one another as well and can meet at the same point in the travel of the strand from the respective nozzle orifices. The air jets from opposite sides of the nozzle passage or orifice from which the melt emerges can be symmetrical to the plane of the melt orifices.

It has been found to be advantageous to provide the nozzle or nozzle tip with a flattened surface at which the aforementioned bores open. This feature of the invention is independent of the features previously described and to be described subsequently since it does not depend upon the air jets or how the inserts in the bores are formed and their particular configurations. It suffices that the nozzle passages formed by the inserts, i.e. defined between the outer periphery of each insert and the respective wall of a bore, terminate in the plane of the flat surface of the nozzle at the outlet side thereof. When a reference is made to a flattened nozzle in this sense, we mean to indicate that the nozzle itself does not come to a pointed tip but rather is truncated so that the bores terminate in a plane of the nozzle which is perpendicular to axes of these bores and, of course, to the nozzle passages formed therein.

The nozzle passages and the bores at the flattened end of the nozzle can communicate with the melt passage preferably at the edges of the outlet surface, i.e. the planar or flat surface, guide flanks project in the direction in which the molten strands emerge. These flanks are provided on opposite longitudinal edges of the outlet surface.

It is also a feature of the invention to provide compressed air passages which can supply the blowing air directly to the outlet surface. The outlet for the blowing air can here lie in the aforementioned plane or at the planar surface. The flattening of the nozzle or nozzle tip is aerodynamically compensated or neutralized by the aforedescribed guide flank and the compressed air outlet in the outlet surface or plane.

It has been found to be advantageous, moreover, to form the nozzle passages in the outer surface of the insert or shaped body which is received in the bore. The nozzle passage itself can be formed as a groove in the outer surface of the insert and can be engraved or otherwise machined therein. A plurality of nozzle passages may be provided in the outer surface of each such insert and preferably over the entire circumference thereof or only over a part of the circumference. The grooves can be of U-shape cross section or of semicircular cross section.

Another feature of the invention, which is also of independent significance, is that the inserts can taper over the lengths thereof. The "length" here means the extent of the shaped body in the direction of the longitudinal axis of the bore in which it is to be received or the nozzle passages thereof.

Preferably the taper of the insert toward the outlet end of the nozzle and the outlet surface or plane serves to fix the insert in the bore. The cross section of the insert thus preferably becomes smaller toward the outlet ends or outlet openings of the nozzle passages. Under the pressure of the melt, the insert is held firmly in the bore and, when that pressure is relieved, the insert can be removed and replaced by a different insert with, for example, a different number of orifices or nozzle passages or with orifices and nozzle passages of different sizes Advantageously the insert is of circular cross section. The circular cross section and taper can define an insert which is frustoconical. However, the insert can be of prismatic shape or can have a square or other polygonal cross section and can taper toward its outlet end or side.

According to a feature of the invention at least one row of bores, each receiving a respective insert or shaped body, extends over the width of the apparatus or nozzle. The row can lie along a straight line. However, in a preferred embodiment, two rows of such bores with respective inserts are provided and the bores of one row can be offset from the bores of the other row so as to be located between them in the longitudinal direction of the nozzle. Of course the invention also encompasses a nozzle having a single bore for a single insert body as has been noted.

The nozzle can be composed of a metal, preferably steel, although it is within the scope of this invention that the nozzle be composed entirely or partly of a thermally insulating material or a material of low thermal conductivity as, for example, a ceramic. The insert body or insert bodies can be composed of the same material as the nozzle.

With the system of the invention, a large number of nozzle passages and orifices can be provided in a relatively small space and with high versatility. For example, a surprisingly high orifice density of up to 100 nozzle passages or orifices per cm or higher can be achieved because of the high orifice density and relatively small orifice cross section, very fine filaments and thus fine fibers can be produced.

However, when desired, the nozzle can have a low orifice density, say one to two orifices per cm, corresponding to one to two nozzle passages per cm. The latter approach can be advantageous for producing products which lie between melt blown products (webs) and spun bond products. The nozzle passages can be formed in an inexpensive and simple manner by the milling of the outer peripheries of the insert body. As has been noted, the invention is particularly advantageous when a replacement of the insert bodies allows the number, size and arrangement of the nozzle passages to be varied.

BRIEF DESCRIPTION OF THE DRAWING

The above and other objects, features, and advantages will become more readily apparent from the following description, reference being made to the accompanying drawing in which.

SPECIFIC DESCRIPTION

Figure 8:
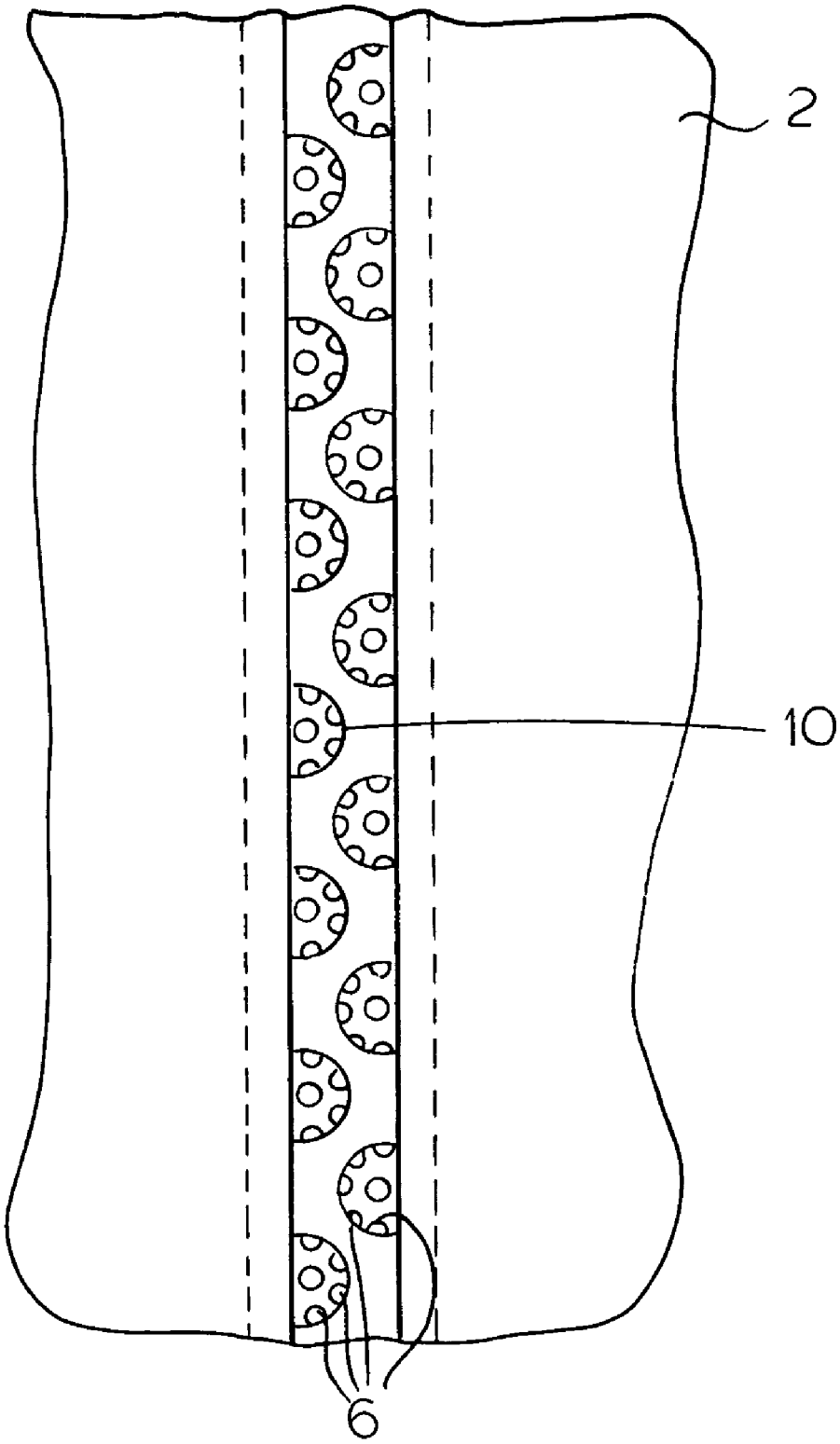
FIG. 8 is a bottom view of the nozzle of FIG. 1.

The drawing shows a device for producing fibers from thermal plastic synthetic resin in which the blowing head 1 is provided with a nozzle 2. Within the nozzle 2 is a melt passage 3 through which molten synthetic resin is fed by a screw-type extrusion. The nozzle 2 has at such outlet end 4 a multiplicity of nozzle passage 5 with nozzle orifices 6 at the bottom ends thereof (FIG. 8). Molten synthetic resin strands emerge from these orifices.

In addition, the blowing head 1 has passages 7 through which compressed air is fed to the outlet end of the nozzles 2 to impinge at acute angles against the strand and tear the strand into fibers which can cool and be collected on a surface into a nonwoven mat or web. The passages 7 extend preferably over the entire width of the nozzle 2 and the head 1, i.e. in a direction perpendicular to the paper plane.

The passages 7 are bounded at the outlet end of the nozzle 2 by a pair of flanks 13 which project from the nozzle 2 along opposite longitudinal edges of a flat surface or plane at which the orifices 6 open. They are bounded as well by a pair of lips which extend at acute angles $\alpha$ to a plane perpendicular to the axis of the orifice and to the strand. The lips 9 define the outlet opening 8. The angle $\alpha$ is preferably about 50° and can range from 30 to 70°.

According to the invention, at the outlet end 4 of the nozzle 2, bores 10 are formed in which respective inserts for shaped bodies 11 are fitted. The inserts 11 have configurations which are complementary to that of the bores so that they are formfittingly engaged therein. Each of the inserts is provided with a multiplicity of the nozzle passages 5 which terminate in the orifices 6. The nozzle passages 5 are milled in the outer peripheries of the inserts 11. The nozzle passages 5 may have U-shaped cross sections or semicircular cross sections as shown. In one embodiment the nozzle passages 5 are provided over only half the periphery of the inserts 11, i.e. are distributed in spaced-relationship around 180° for each insert. The passages 5 may, however, extend over angles of greater than 180°, e.g. over the entire 360° (FIG. 7) and can vary in number and in size (compare FIGS. 5 and 7).

Figure 1:
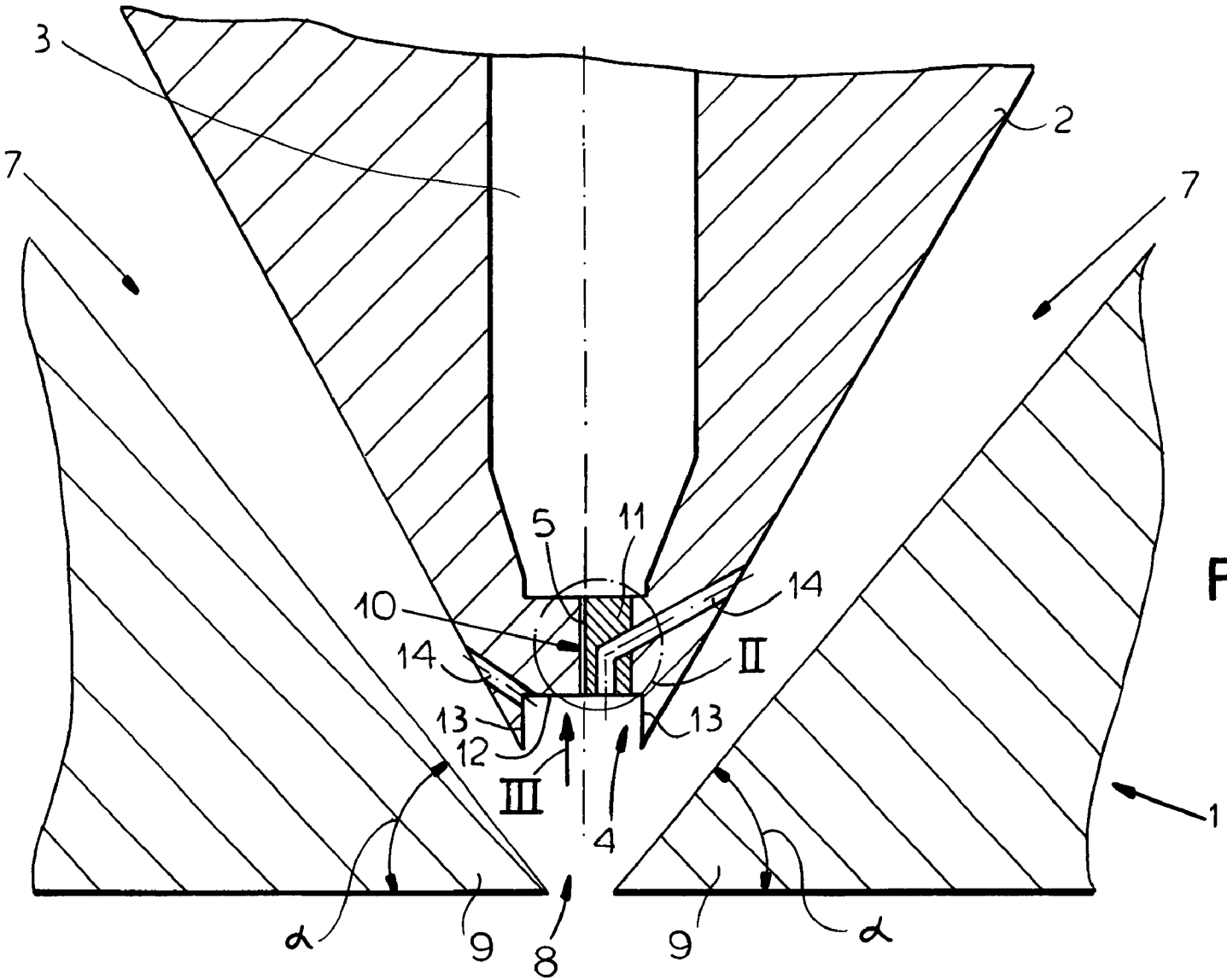
FIG. 1 is a cross sectional view through a nozzle in accordance with the invention.
Figure 4:
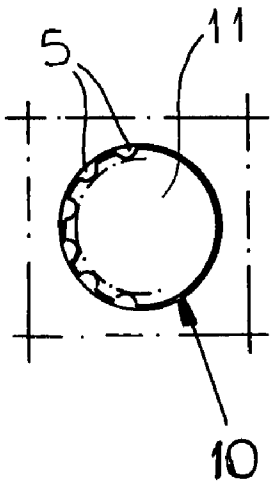
FIG. 4 is a detail of FIG. 3.
Figure 3:
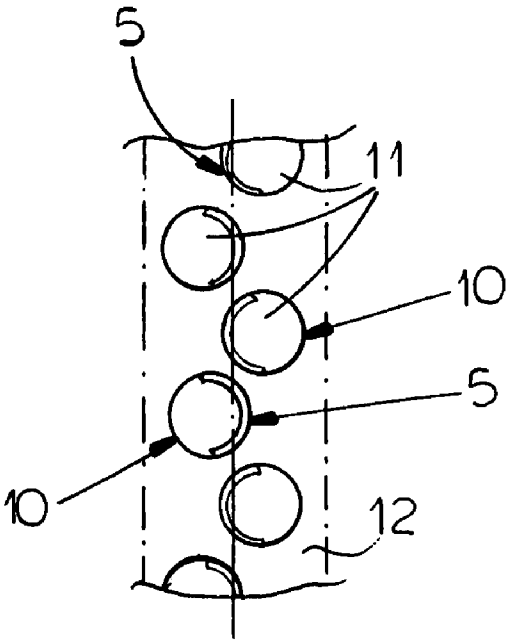
FIG. 3 is a view in the direction of the arrow III in FIG. 1, namely a bottom view of the planar outlet surface at which the bores of the nozzle of FIG. 1 terminate.

From FIG. 1 it can also be seen that the inserts allow at their lower ends in the plane of a flattened portion 12 of the nozzle 2 at which the bores 10 open. The nozzle passages 5 communicate with the melt passage 3. The surface 12 lies perpendicular to the axes of the bores 10 and the nozzle channels 5 and can be horizontal, extending over the entire width of nozzle 2, i.e. perpendicular to the plane of the paper in FIG. 1.

Along the edges of the surface 12, guide flanks 13 project perpendicularly to the surface 12. In addition, compressed air passages 14 open at the surface 12, i.e. via bores 20 in the inserts. The compressed air passages may be branched (see FIG. 1) from the passages 7 previously described. The flattening of the nozzle 2 or the nozzle tip can be neutralized or compensated by the guide flanks and/or the compressed air passages 14.

Figure 2:
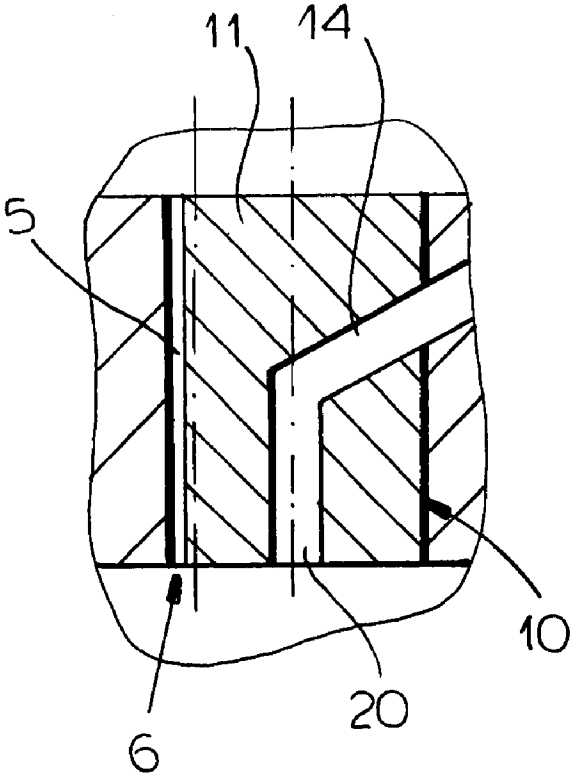
FIG. 2 is a detail of the region II in FIG. 1.

As can be seen from FIG. 2, the inserts 11 which are received in the bores 10 can be tapered and of frustoconical shape, having a smaller diameter at the discharge end. Naturally the bores 10 are similarly tapered and both the bores and the inserts 11 are of frustoconical shape. The inserts can thus be held in place by the pressure of the molten synthetic resin.

Figure 7:
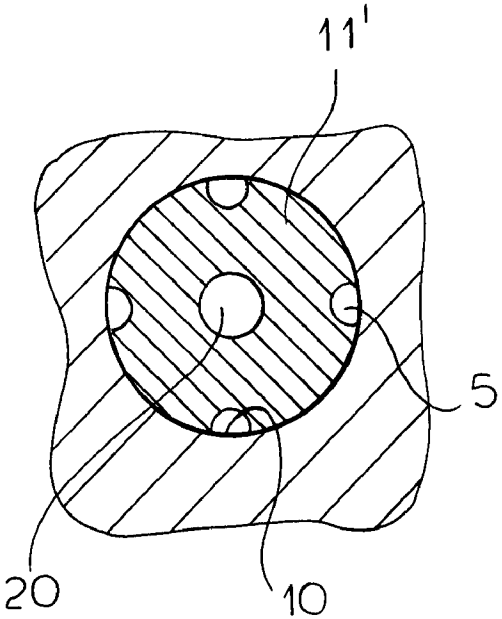
FIG. 7 is a cross sectional view through the nozzle of the larger scale of FIGS. 5 and 6 but wherein a different insert is provided.
Figure 6:
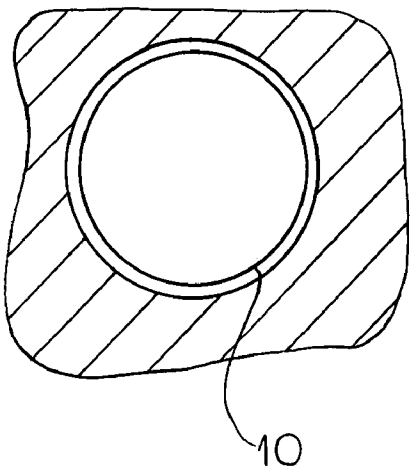
FIG. 6 is a cross sectional view through one of the bores in the direction of the bore outlet end and from which the insert body has been removed.
Figure 5:
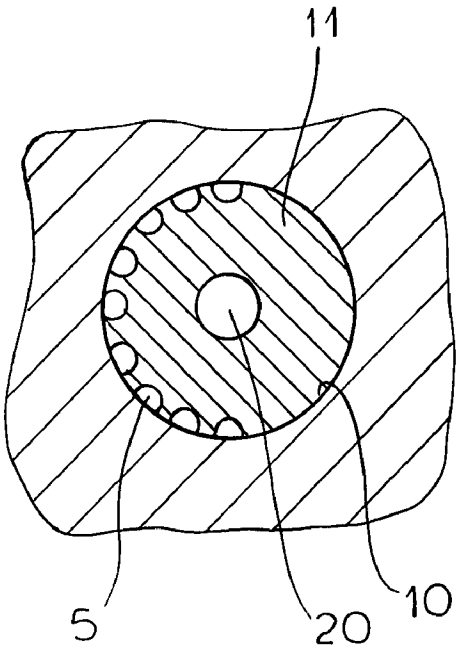
FIG. 5 is a cross sectional view through a bore and an insert drawn to a larger scale than in the previous Figures.

As will be apparent form FIGS. 5–7, the inserts 11 can be removed from the respective bores 10 (see FIG. 6) and replaced by other inserts, e.g. the insert 11' of FIG. 7 which may have a different number of channels 5 or channels of different size or orientation. This allows the number and/or sizes and/or arrangements of the nozzle channels 5 and their orifices 6 to be varied in a simple manner.

From FIG. 2 it will be apparent that two rows of bores 10 for respective inserts 11 can be provided. The bores 10 of the two rows are staggered with respect to one another. The nozzle however can have only a single row of bores or more than two rows of bores if desired.

We claim:

1. A device for producing fibers of a thermoplastic synthetic resin, comprising:

a nozzle body formed with at least one melt passage for a molten thermoplastic synthetic resin and, at an outlet side of said nozzle body with a multiplicity of bores communicating with said passage, said outlet side of said nozzle body having a flat surface at which said bores open; and respective members shaped to fit into said bores and received therein, each of said members being formed along an outer periphery thereof, in a region of contact with a wall of the respective bore, at least one nozzle channel for said melt opening at a discharge orifice in the bore at said flat surface.

2. The device defined in claim 1, further comprising a compressed-air feed for directing compressed air at an acute angle onto a thermoplastic synthetic resin strand emerging from said orifice.

3. The device defined in claim 2, further comprising guide flanks formed along opposite edges of said surface and extending generally perpendicular thereto.

4. The device defined in claim 2, further comprising compressed-air passages opening at said surface.

5. The device defined in claim 1, wherein each of said members is formed with a multiplicity of said channels in the periphery thereof.

6. The device defined in claim 4 wherein each of said members tapers over the length thereof.

7. The device defined in claim 6 wherein each of said members is frustoconical in configuration.

8. The device defined in claim 4 wherein said nozzle body has at least one row of said bores extending over a width of the nozzle body.

9. The device defined in claim 2 wherein each of said members is formed with a multiplicity of said channels in the periphery thereof.

10. The device defined in claim 1 wherein each of said members tapers over the length thereof.

11. The device defined in claim 10 wherein each of said members is frustoconical in configuration.

12. The device defined in claim 1 wherein said nozzle body has at least one row of said bores extending over a width of the nozzle body.

* * * * *